US008827845B1

(12) United States Patent
Griffin

(10) Patent No.: US 8,827,845 B1
(45) Date of Patent: Sep. 9, 2014

(54) FRISBEE DISC GOLF PRACTICE TOWER

(76) Inventor: Mark F. Griffin, Mooresville, NC (US)

( * ) Notice: Subject to any disclaimer, the term of this patent is extended or adjusted under 35 U.S.C. 154(b) by 227 days.

(21) Appl. No.: 13/454,191

(22) Filed: Apr. 24, 2012

(51) Int. Cl.
*A63B 63/00* (2006.01)
*A63B 69/00* (2006.01)

(52) U.S. Cl.
CPC ..... *A63B 63/00* (2013.01)
USPC ..... 473/446; 273/400

(58) Field of Classification Search
USPC ..... 473/446; 108/115, 176, 181; 211/88.01; 273/401, 400; D6/566
See application file for complete search history.

(56) References Cited

U.S. PATENT DOCUMENTS

| | | | | | |
|---|---|---|---|---|---|
| 198,454 | A * | 12/1877 | French | 108/176 |
| 469,554 | A * | 2/1892 | Favor | 273/401 |
| 1,527,988 | A * | 3/1925 | McMurtrie | 273/400 |
| 1,727,048 | A * | 9/1929 | Cady | 108/176 |
| 4,297,795 | A * | 11/1981 | Licari | 34/239 |
| 4,407,507 | A * | 10/1983 | Caruso et al. | 273/400 |
| 5,080,375 | A * | 1/1992 | Moosavi | 473/478 |
| 5,253,770 | A * | 10/1993 | Rosenthal | 211/133.3 |
| 5,893,563 | A * | 4/1999 | Buller | 273/400 |
| 6,173,847 | B1 * | 1/2001 | Zellner et al. | 211/186 |
| 6,554,285 | B2 * | 4/2003 | Chittenden | 273/400 |
| 6,776,417 | B1 * | 8/2004 | Holgate | 273/400 |
| 7,500,675 | B2 * | 3/2009 | Sandman | 273/400 |
| 8,075,425 | B2 * | 12/2011 | Conwright | 473/422 |
| 2005/0269784 | A1 * | 12/2005 | Peters | 273/343 |
| 2010/0062880 | A1 * | 3/2010 | Hayes | 473/422 |

* cited by examiner

*Primary Examiner* — Gene Kim
*Assistant Examiner* — M Chambers
(74) *Attorney, Agent, or Firm* — Kyle A. Fletcher, Esq.

(57) ABSTRACT

The Frisbee disc golf practice tower includes a plurality of vertically stacked baskets that collect Frisbee discs that are thrown into a front opening of each basket, and which are used as a means of practicing Frisbee golf putting or in connection with a game. The baskets are formed from a plurality of tubular components that connect, and from which netting spans along each basket at a rear surface, side surfaces, and a bottom surface. A top basket includes a backboard that enables a bank shot to be made therein. The tubular construction of the practice tower can collapse between uses, and arise from base members that secure the practice tower upon different ground surfaces.

12 Claims, 5 Drawing Sheets

FIG. 5
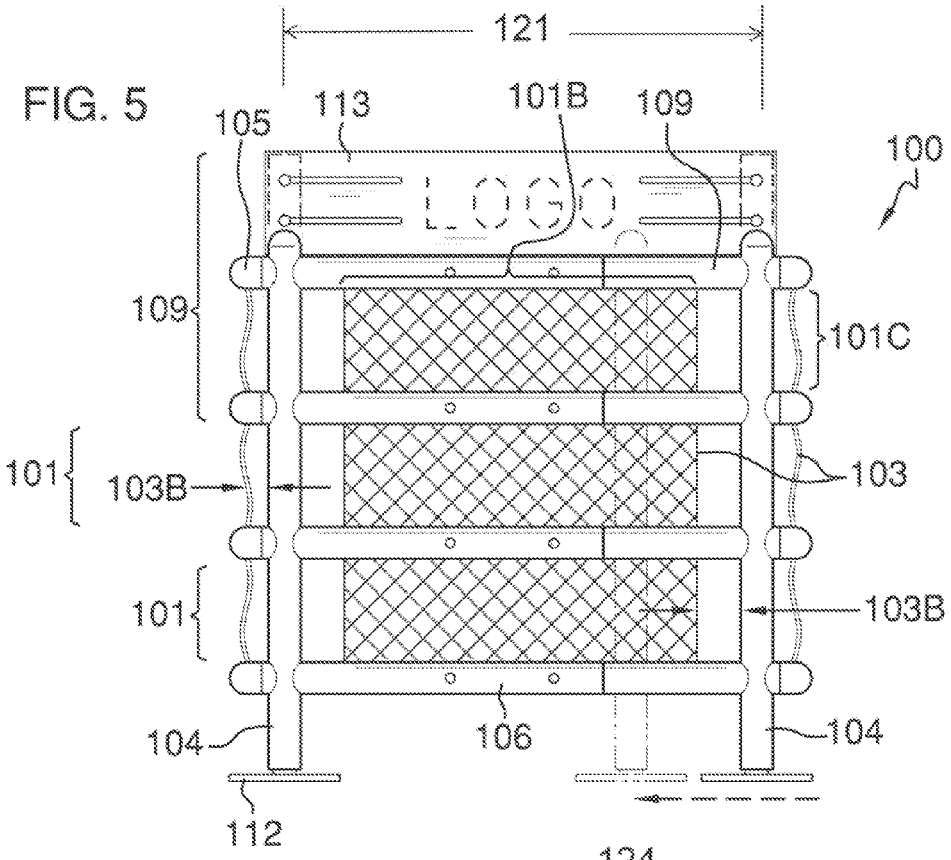
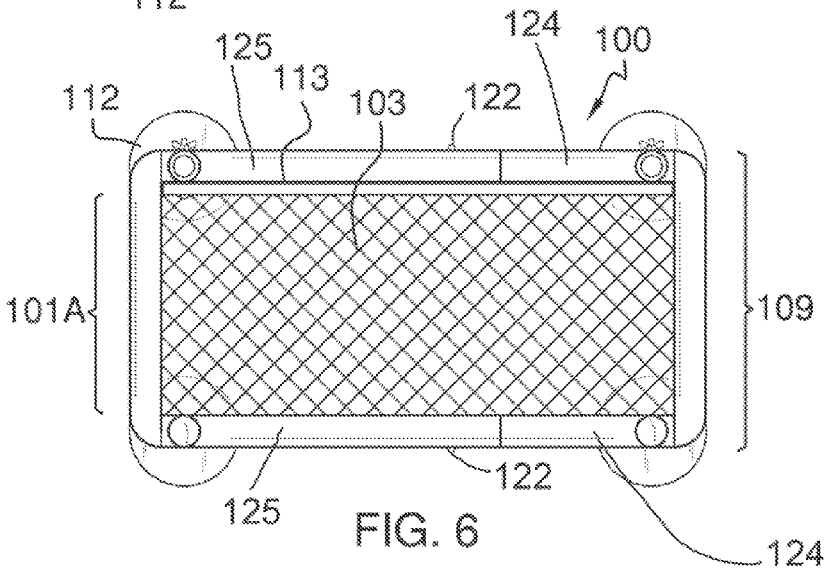
FIG. 6

FRISBEE DISC GOLF PRACTICE TOWER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of Frisbee golf, more specifically, a disc tower that is used to practice Frisbee golf.

B. Discussion of the Prior Art

As will be discussed immediately below, no prior art discloses a Frisbee disc golf practice tower including a plurality of vertically stacked baskets, which yield different point values upon throwing a Frisbee disc therein from a predetermined distance; wherein each basket includes netting along the sides, rear, and bottom surfaces to collect Frisbee discs thrown therein; wherein a top basket includes a backboard that may be used to bank a shot into the top basket, and said backboard may double as a location for advertising indicia; wherein the practice tower enables an end user to practice the competitive game upon use there with; wherein the practice tower is of tubular construction, and which is capable of collapsing when not in use.

The Peters Patent Application Publication (U.S. Pub. No. 2005/0269784) discloses a tossing game and method for throwing a plurality of bola-type projectiles at a tiered target. However, the tossing game involves a tiered target and is for use with bol-styled projectiles as opposed to a plurality of vertically stacked baskets that provide different pointing values for use in practicing Frisbee golf putting.

The Buller patent (U.S. Pat. No. 5,893,563) discloses a game apparatus for use with thrown objects. However, the game apparatus is not a plurality of vertically stacked baskets that form places within which a Frisbee disc may land, and which can be used as a practice tower for Frisbee golf putting or for use in playing a game there with.

The Chittenden patent (U.S. Pat. No. 6,554,285) discloses an entrapment assembly suitable for use as a "hole" in a flying disc golf game. However, the entrapment assembly is not a plurality of vertically stacked baskets formed of netting along sides, rear, and bottom surfaces, and which collect Frisbee discs thrown therein, and which provides a means of practicing the putting portion of a Frisbee golf game.

The Holgate patent (U.S. Pat. No. 6,776,417) discloses a disc golf target configured for improved and consistent disc capture, and which is easily collapsible for portability. However, the disc golf target is not a plurality of vertically stacked baskets that form a practice tower into which Frisbee discs are thrown.

The Sandman patent (U.S. Pat. No. 7,500,675) discloses a flying target assembly that is lighter and more portable than traditional disc golf targets while still effectively engaging and stopping the flight of a flying disc and dropping the disc by gravity into an open top basket. However, the flying disc target assembly does not include a plurality of vertically stacked baskets that form a practice tower from which Frisbee discs may be thrown, and which aids in the practice of the putting portion associated with Frisbee golf.

The Licari patent (U.S. Pat. No. 4,297,795) discloses a portable drying rack. However, the drying rack is not a collapsible practice tower for use with Frisbee discs, and which includes a plurality of vertically stacked baskets.

The Carrington patent (U.S. Pat. No. Des. 612,558) illustrates an ornamental design for a multi-tiered drying rack, which does not disclose a basket that includes netting along sides, rear, and bottom surfaces.

While the above-described devices fulfill their respective and particular objects and requirements, they do not describe a Frisbee disc golf practice tower including a plurality of vertically stacked baskets, which yield different point values upon throwing a Frisbee disc therein from a pre-determined distance; wherein each basket includes netting along the sides, rear, and bottom surfaces to collect Frisbee discs thrown therein; wherein a top basket includes a backboard that may be used to bank a shot into the top basket, and said backboard may double as a location for advertising indicia; wherein the practice tower enables an end user to practice the putting stroke associated with Fribsee golf while forming a competitive game upon use there with; wherein the practice tower is of tubular construction, and which is capable of collapsing when not in use. In this regard, the Frisbee disc golf practice tower departs from the conventional concepts and designs of the prior art.

SUMMARY OF THE INVENTION

The Frisbee disc golf practice tower includes a plurality of vertically stacked baskets that collect Frisbee discs that are thrown into a front opening of each basket, and which are used as a means of practicing Frisbee golf putting or in connection with a game. The baskets are formed from a plurality of tubular components that connect, and from which netting spans along each basket at a rear surface, side surfaces, and a bottom surface. A top basket includes a backboard that enables a bank shot to be made therein. The tubular construction of the practice tower can collapse between uses, and arise from base members that secure the practice tower upon different ground surfaces.

It is an object of the invention to provide a Frisbee disc golf practice tower that includes a plurality of vertically stacked baskets with which a Frisbee disc is thrown into a front opening.

A further object of the invention is to provide baskets that are constructed of several pieces of netting that extend across a rear surface, side surfaces, and a bottom surface.

A further object of the invention is to provide a practice tower of tubular construction with which the netting attaches and spans across the several surfaces.

An even further object of the invention is to create the practice tower of tubular construction, which can collapse between uses.

Another object of the invention is to provide supports from which the practice tower extends vertically, and which secures the practice tower onto different ground surfaces.

Another object of the invention is to provide a backboard on a top basket, which enables bank shots to be made into the top basket, which includes a front opening as well as a top opening.

Another object of the invention is to enable the entire practice tower to extend or retract along a width of the tower thereby enabling the applicable width and area to be adjustable for use in practicing a putting stroke with a Frisbee disc golf putter.

These together with additional objects, features and advantages of the Frisbee disc golf practice tower will be readily apparent to those of ordinary skill in the art upon reading the following detailed description of presently preferred, but nonetheless illustrative, embodiments of the Frisbee disc golf practice tower when taken in conjunction with the accompanying drawings.

In this respect, before explaining the current embodiments of the Frisbee disc golf practice tower in detail, it is to be understood that the Frisbee disc golf practice tower is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the Frisbee disc golf practice tower.

It is therefore important that the claims be regarded as including such equivalent construction insofar as they do not depart from the spirit and scope of the Frisbee disc golf practice tower. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 5 illustrates a front view of the Frisbee disc golf practice tower with an arrow indicating adjustment of the width of the Frisbee disc golf practice tower;

FIG. 6 illustrates a top view of the Frisbee disc golf practice tower; and

DETAILED DESCRIPTION OF THE EMBODIMENT

Figure 1:
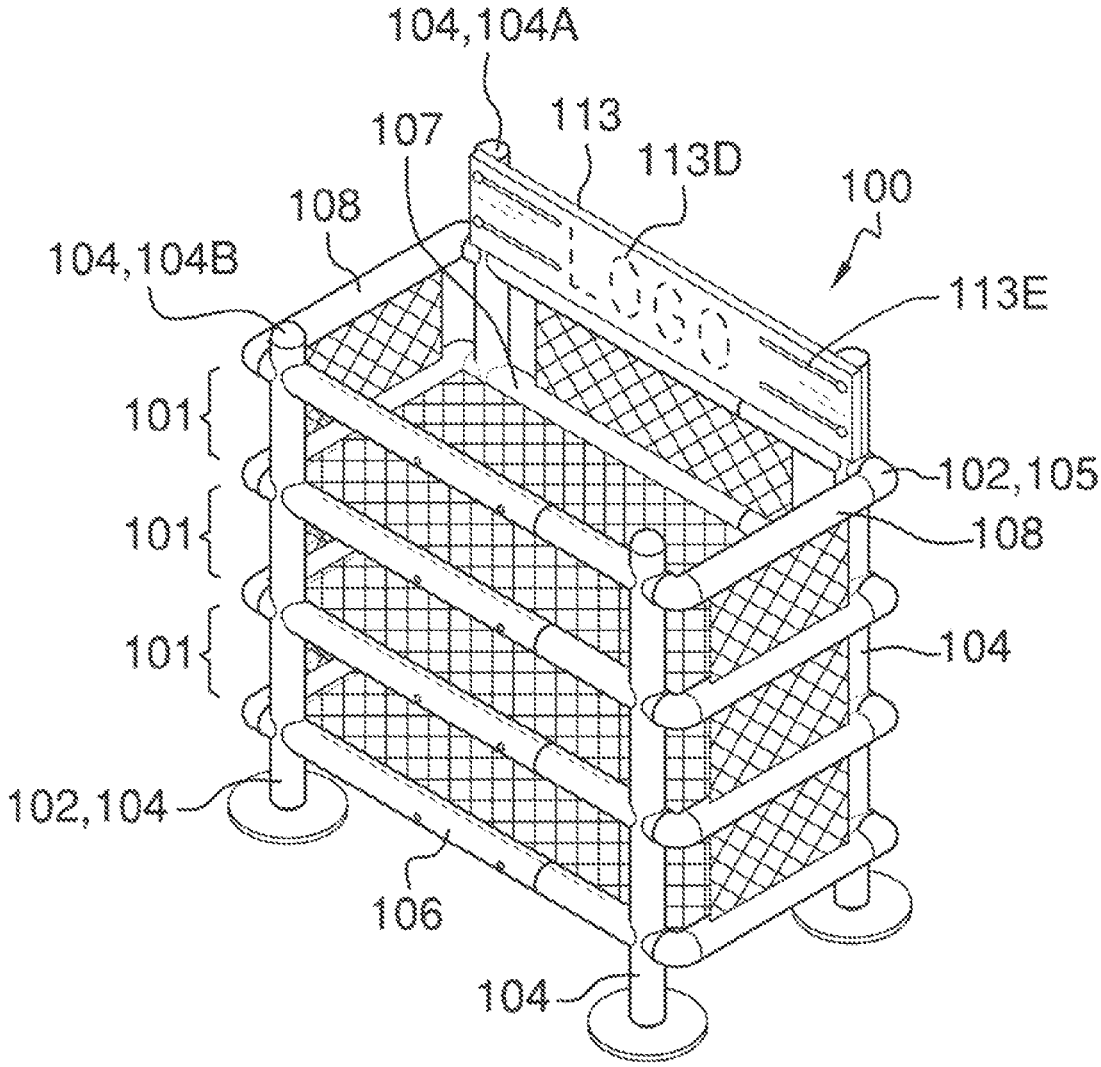
FIG. 1 illustrates a front, perspective view of the Frisbee disc golf practice tower by itself and fully erected with the base members located under the practice tower, and detailing the several vertically stacked baskets formed of several pieces of netting.
Figure 2:
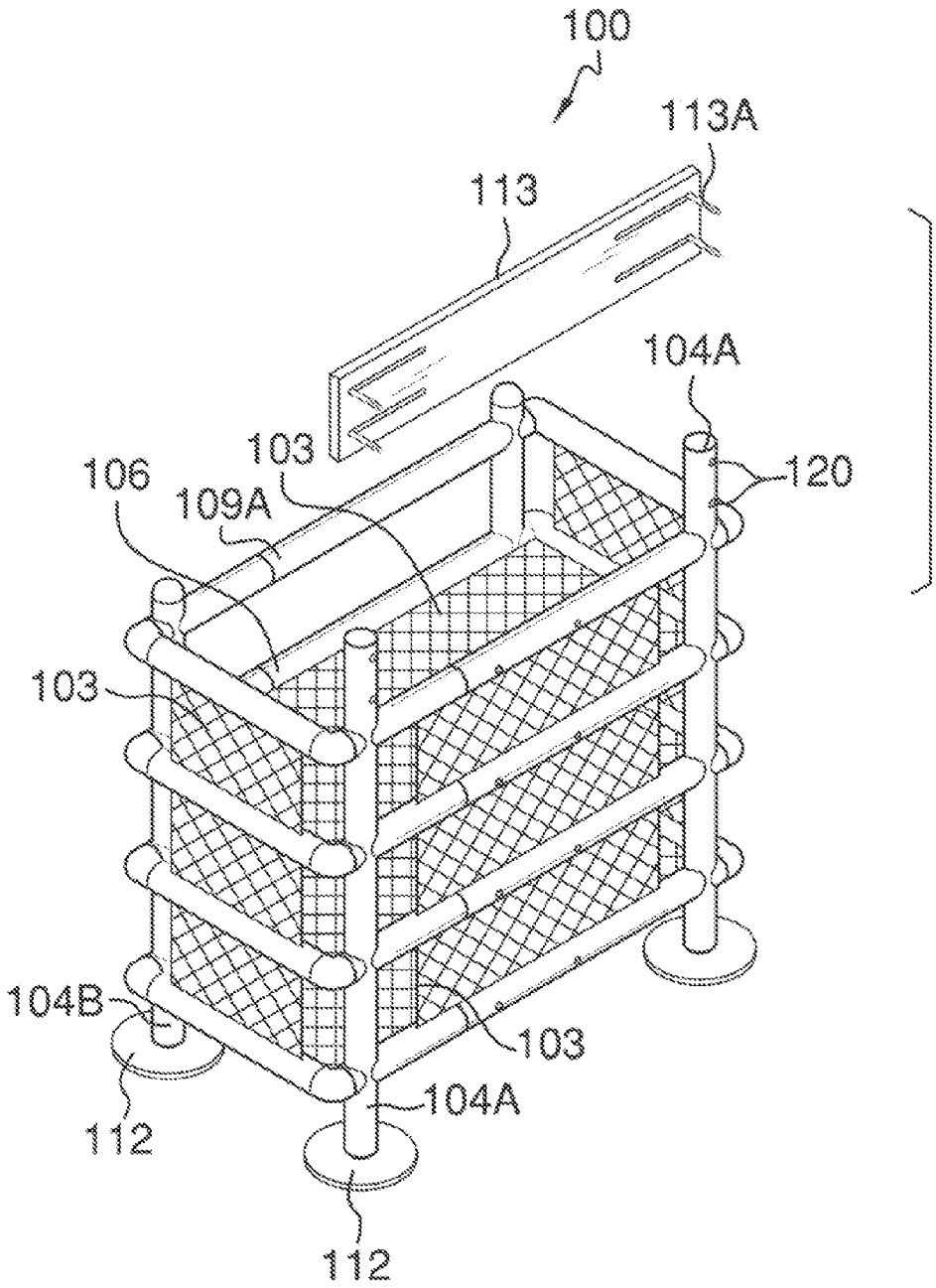
FIG. 2 illustrates a rear, perspective view of the Frisbee disc golf practice tower in which the backboard is detached from the practice tower in order to detail the construction of the bolts extending from the back surface of the backboard.
Figure 3:
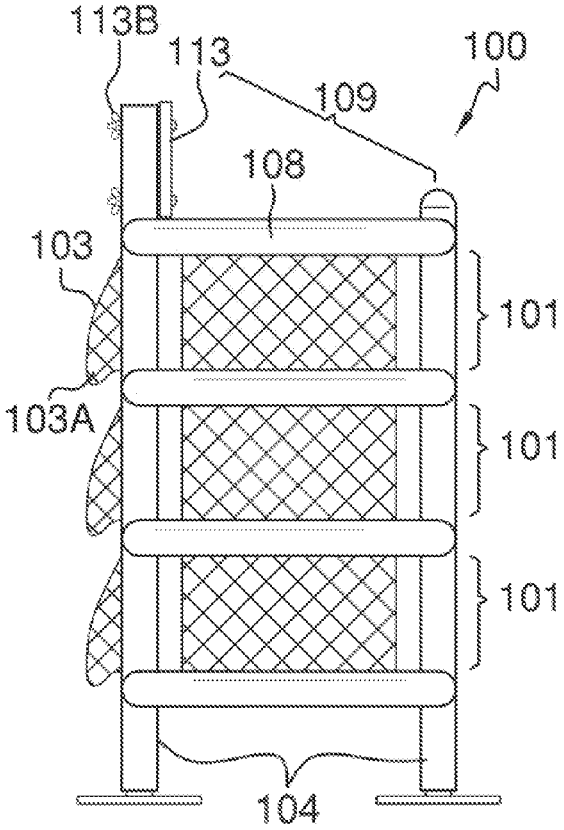
FIG. 3 illustrates a side view of the Frisbee disc golf practice tower.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-7. A Frisbee disc golf practice tower 100 (hereinafter invention) includes a plurality of vertically stacked baskets 101 composed of tubular components 102 from which netting 103 attaches. It shall be noted that the number of stacked baskets 101 is otherwise undefined, however the figures depict a total of 3 stacked baskets 101.

The tubular components 102 may be of hollowed construction in order to limit the overall weight of the invention 100. The netting 103 is of no particular size, and is flexible.

The tubular components 102 may be further defined by four vertical posts 104, which establishes the corners of the invention 100. The vertical posts 104 extend vertically at which elbow hinges 105 intersect at predetermined elevations. A front support 106, a rear support 107, and side supports 108 connect at the elbow hinges 105 to form a rectangularly-shaped opening, which defines a bottom surface 101A of each basket 101. Netting 103 attaches to the tubular components 102, and covers the bottom surface 101A, a rear surface 101B, and side surfaces 101C. The netting 103 in conjunction with the vertical posts 104, the elbow hinges 105, the front support 106, the rear support 107, and the side supports 108 form the baskets 101.

A top basket 109 is different from the baskets 101 remaining below in that the top basket 109 includes a front opening 110 as well as a top opening 111. Additionally, it shall be noted that the top basket 109 includes a top, front support 109A, which helps to define the top basket 109 over the baskets 101 located there under. The top, front support 109A requires an end user 140 to throw the Frisbee disc 130 either over or under the top, front support 109A in order to land the Frisbee disc 130 into the top basket 109 (see FIGS. 2 and 7).

It shall be noted that the netting 103 that spans across the rear surface 101B shall be loose forming, and may include a pouch 103A. It shall be further noted that the netting 103 located along the rear surface 101B as well as the side surfaces 101C is not entirely encompassing. Moreover, the netting 103 leaves openings 103B between the netting 103 and the vertical posts 104, which enables the rotational movement for collapse of the invention 100 to occur.

Figure 4:
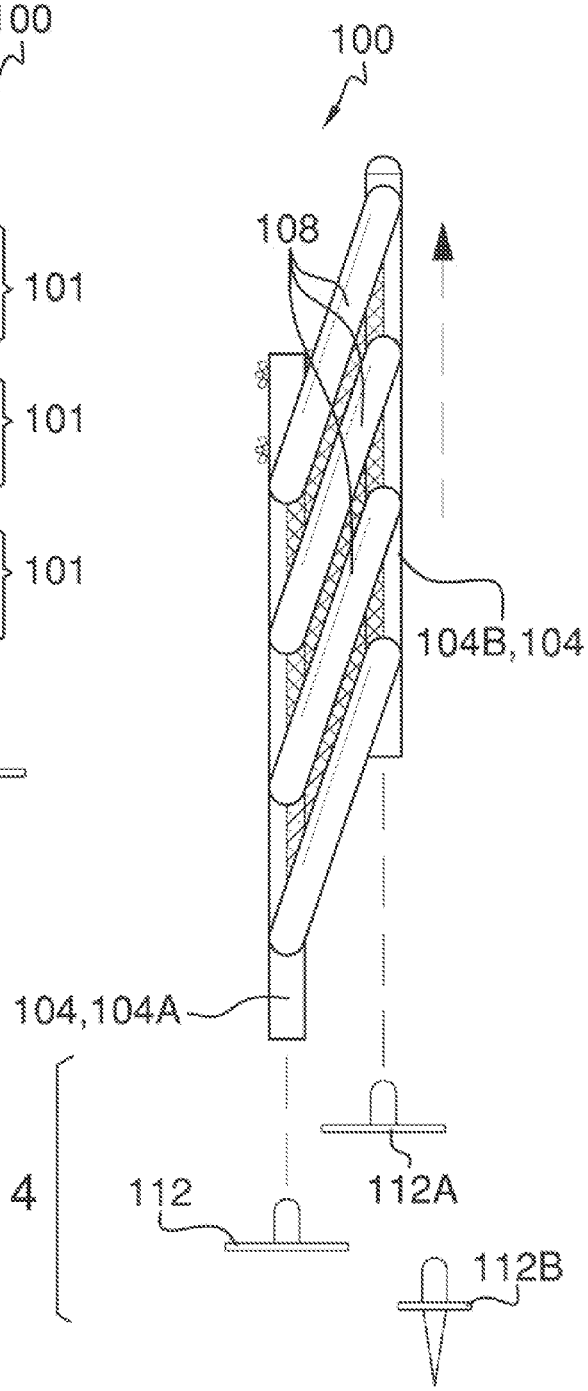
FIG. 4 illustrates a side view of the Frisbee disc gold practice tower in which the base members are removed therefrom, and further detailing collapse of the tubular members forming the practice tower.

The vertical posts 104 each include a base member 112, which is a plated member that attaches from underneath the respective vertical posts 104. The base member 112 provides stability to the invention 100. Referring to FIG. 4, the base member 112 may include a suction cup 112A for attachment with a smooth ground surface, or a stake 112B.

Rear vertical posts 104A have an overall length greater than that of the front vertical posts 104B. The rear vertical posts 104A enable a backboard 113 to attach above the rear surface 101B of the top basket 109 thereby enabling a bank shot to be made with a Frisbee disc 130. The backboard 113 includes bolts 113A and wing nuts 113B, which collectively fasten the backboard 113 to the rear vertical posts 104A at holes 120 provided thereon (see FIG. 3). It shall be noted that the backboard 113 may include advertising indicia 113D provided thereon. The bolts 113A are able to slide along grooves 113E provided on the blackboard 113 in order for the invention 100 to adjust in width.

Referring to FIG. 4, upon removal of the base member 112, the invention 100 may be collapsed upon rotation of the side supports 108 with respect to the vertical posts 104. It shall be noted that the side supports 108 can rotate with respect to the vertical posts 104 via the elbow hinges 105. The ability to collapse the invention 100 makes for ease of use when storing the invention 100 between uses.

Figure 7:
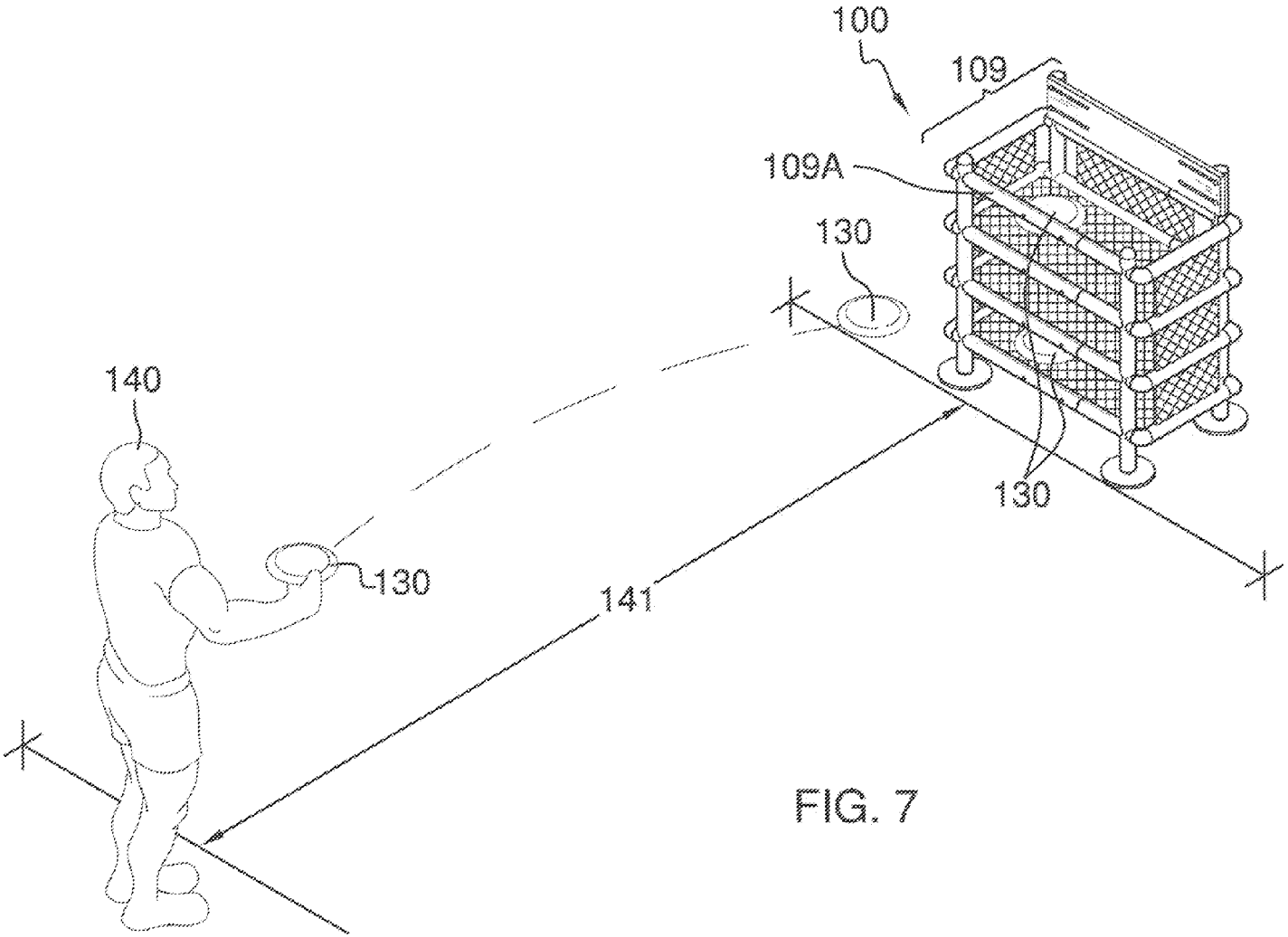
FIG. 7 illustrates a view of the Frisbee disc golf practice tower in use.

It shall be noted that the invention 100 shall require the end user 140 to stand a predetermined distance 141 away from the invention 100 before throwing the Frisbee discs 130 (see FIG. 7). Moreover, the invention 100 is used to practice Frisbee disc golf putting or to play a game in which the object is to score more points than an opponent. In the event the invention 100 is used to play a game it shall be noted that each basket 101 and the top basket 109 may be awarded different numbers of points for throwing the Frisbee disc therein.

It shall be noted that the invention 100 shall be further defined by a width 121, which is adjustable. The width 121 of the invention 100 is adjusted by the use of and incorporation of spring-loaded buttons 122 that interact and align with a plurality of holes 123. The front support 106 and the rear support 107 are both inclusive of the spring-loaded button 122 and holes 123. The front support 106 and the rear support 107 are each further defined with a first member 124 and a second member 125 whereby the first member 124 slides with respect to the second member 125. Moreover, the first member 124 includes the spring-loaded button 122 whereas the second member 125 includes the holes 123.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A Frisbee disc golf practice tower comprising:

a plurality of vertically stacked baskets formed of tubular components and netting in which each of the baskets is open along a front, while netting spans across at least a portion of a bottom surface, side surfaces, and a rear surface;

wherein the Frisbee disc golf practice tower enables Frisbee discs to be thrown into the baskets for putting practice associated with Frisbee Golf or as a game involving different point values associated with the different vertically stacked baskets;

wherein the tubular components include four vertical posts at which elbow hinges intersect at predetermined elevations; wherein a front support, a rear support, and side supports connect at the elbow hinges to form a rectangularly-shaped opening, which defines said bottom surface of each basket;

wherein a top basket is provided all of the vertically stacked baskets, and is open along a front surface as well as from above; wherein the top basket includes a top, front support, which requires the thrown Frisbee disc to fall into either over or under the top, front support in order to land the Frisbee disc into the top basket wherein the netting located along the rear surface as well as the side surfaces leaves openings between the netting and the vertical posts and wherein the side supports rotate with respect to the vertical posts via the elbow hinges, which provides a means for collapse of the Frisbee disc golf practice tower.

2. The Frisbee disc golf practice tower as described in claim 1 wherein the vertical posts each include a base member, which is a plated member that attaches from underneath the respective vertical posts.

3. The Frisbee disc golf practice tower as described in claim 2 wherein the base member includes a suction cup or a ground-penetrating stake.

4. The Frisbee disc golf practice tower as described in claim 1 wherein the four vertical posts are further defined as two rear vertical posts and two front vertical posts; wherein the rear vertical posts have an overall length greater than that of the front vertical posts.

5. The Frisbee disc golf practice tower as described in claim 4 wherein the rear vertical posts enable a blackboard to attach above the rear surface of the top basket via bolts and wing nuts.

6. The Frisbee disc golf practice tower as described in claim 1 wherein a top basket is provided above all of the vertically stacked, and is open along a front surface as well as from above.

7. The Frisbee disc golf practice tower as described in claim 1 wherein the netting spans across the rear surface, and forms a pouch.

8. A Frisbee disc golf practice tower comprising:

a plurality of vertically stacked baskets formed of tubular components and netting in which each of the baskets is open along a front, while netting spans across at least a portion of a bottom surface, side surfaces, and a rear surface;

wherein the Frisbee disc golf practice tower enables Frisbee discs to be thrown into the baskets for putting practice associated with Frisbee Golf or as a game involving different point values associated with the different vertically stacked baskets;

wherein the tubular components include four vertical posts at which elbow hinges intersect at predetermined elevations; wherein a front support, a rear support, and side supports connect at the elbow hinges to form a rectangularly-shaped opening, which defines said bottom surface of each basket;

wherein a top basket is provided above all of the vertically stacked, and is open along a front surface as well as from above; wherein the top basket includes a top, front support, which requires the thrown Frisbee disc to fall into either over or under the top, front support in order to land the Frisbee disc into the top basket;

wherein the netting spans across the rear surface, and forms a pouch;

wherein the netting located along the rear surface as well as the side surfaces leaves openings between the netting and the vertical posts;

wherein the side supports rotate with respect to the vertical posts via the elbow hinges, which provides a means for collapse of the Frisbee disc golf practice tower.

9. The Frisbee disc golf practice tower as described in claim 8 wherein the vertical posts each include a base member, which is a plated member that attaches from underneath the respective vertical posts.

10. The Frisbee disc golf practice tower as described in claim 9 wherein the base member includes a suction cup or a ground-penetrating stake.

11. The Frisbee disc golf practice tower as described in claim 10 wherein the four vertical posts are further defined as two rear vertical posts and two front vertical posts; wherein the rear vertical posts have an overall length greater than that of the front vertical posts; wherein the rear vertical posts enable a blackboard to attach above the rear surface of the top basket via bolts and wing nuts.

12. The Frisbee disc golf practice tower as described in claim 11 wherein the practice tower is able to adjust a width via a spring-loaded button provided on both the front supports and the rear supports; wherein the front supports and the rear supports are each further defined by a first member including the spring-loaded button, and a second member having a plurality of holes located thereon.

* * * * *